US007628230B2

(12) United States Patent
Pessier et al.

(10) Patent No.: US 7,628,230 B2
(45) Date of Patent: Dec. 8, 2009

(54) WIDE GROOVE ROLLER CONE BIT

(75) Inventors: Rudolf C. Pessier, The Woodlands, TX (US); James L. Overstreet, Tomball, TX (US); Robert J. Buske, The Woodlands, TX (US); Don Q. Nguyen, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 557 days.

(21) Appl. No.: 11/191,379

(22) Filed: Jul. 28, 2005

(65) Prior Publication Data

US 2006/0027401 A1 Feb. 9, 2006

Related U.S. Application Data

(60) Provisional application No. 60/598,952, filed on Aug. 5, 2004.

(51) Int. Cl.
*E21B 10/16* (2006.01)

(52) U.S. Cl. ..... 175/341

(58) Field of Classification Search ..... 175/341, 175/374; 76/108.1, 108.2, 108.4
See application file for complete search history.

(56) References Cited

U.S. PATENT DOCUMENTS 3,265,139 A * 8/1966 Haden et al. ..... 175/356
3,946,820 A * 3/1976 Knapp ..... 175/341
4,241,798 A * 12/1980 Jones ..... 175/331
5,311,958 A 5/1994 Isbell et al.

* cited by examiner

*Primary Examiner*—Kenneth Thompson
(74) *Attorney, Agent, or Firm*—Bracewell & Giuliani LLP

(57) ABSTRACT

An earth boring bit has three cones, each cone being mounted for rotation about a cone axis while the bit rotates about a bit axis. An outer row and an adjacent row of cutting elements are integrally formed on each of the cones. Each of the cutting elements of the adjacent row on each of the cones has a crest extending perpendicular to a direction of rotation of the cone. Annular spaces are located between the outer row and the adjacent row on each of the cones. The annular space on one cone has a width that is less than the annular spaces on the other cones. The width of the narrowest annular space is greater than the width of the crests of the adjacent row.

17 Claims, 5 Drawing Sheets

WIDE GROOVE ROLLER CONE BIT

CROSS-REFERENCE TO RELATED APPLICATION

This application claims priority to provisional patent application 60/598,952 filed Aug. 5, 2004.

FIELD OF THE INVENTION

This invention relates in general to earth boring bits, and in particular to the spacing between the rows of cutting elements of a roller cone bit.

BACKGROUND OF THE INVENTION

A typical roller cone earth boring bit, such as used to drill wells, has three cones that roll around a common axis. The cones are mounted to bearing pins that depend from head sections. The head sections are welded together to form a body that is threaded at the upper end for connection to a drill string.

FIGS. 1-3 illustrate a typical prior art rolling cone bit 11. Bit 11 has three cones 13, 15 and 17. Cone 13 has a spear point cutting element 19 on its inner end and a heel or outer row 21 of cutting elements on its outer end. The outer side of each tooth of outer row 21 joins a gage surface 22. The cutting elements in this instance comprise teeth that are integrally formed with cone 13 and milled into desired shapes. Milled teeth are generally chisel-shaped, each having a crest 28 that is perpendicular to the direction of rotation of the bit. Alternately, the cutting elements could be cast with the body of the cone or comprise tungsten carbide inserts pressed into mating holes.

Cone 13 also has an inner row 23 spaced a short distance from outer row 21. A groove 25 locates between outer row 21 and inner row 23. A layer of hardfacing 27, shown by phantom lines, covers each cutting element in outer row 21 and inner row 23. Groove 25 is generally triangular in cross-section and has a width 26 that may be measured between tips of teeth 21, 23 at the crests 28. In the prior art, width 26 is normally less than the width of crest 28 of a cutting element of inner row 23 or of outer row 21.

Referring to FIG. 1, cone 15 has an outer row 29 and an inner row 31 spaced apart by a groove 33. Groove 33 has a much wider width 34 than width 26 of cone 13. In the prior art, width 34 is typically equal or greater than the width of crest 28 of one of the teeth of inner row 31. Cone 17 has an outer row 35 and an inner row 37 spaced apart by a groove 39. Groove 39 has a width 40 that is wider than width 34 and width 26. Width 40 is greater than the width of crest 28 of one of the outer row teeth 35 or inner row teeth 37.

The various rows 21, 23, 29, 31, 35 and 37 are arranged for a desired bottom hole coverage, as indicated in FIG. 2. In FIG. 2, all of the rows of teeth are rotated into a single sectional plane. Some of the teeth intermesh with each other as shown in FIG. 1. The number of rows per cone in the prior art can be more or less than those shown in FIG. 1. In the prior art example shown, there are a total of seven rows, and the narrowest groove width 26 is located on cone number one, which has the spear point. In an eight row bit, the narrowest groove width 26 would be normally on cone 17, which is cone number two. In a nine row bit, the narrowest groove width 26 would be on cone 15, which is cone number three. A narrow groove on one of the cones has been necessary in the prior art in order to achieve intermesh and the desired bottom coverage. While workable, in certain formations such as shales, the cuttings tend to ball up in rows separated by narrow grooves, reducing the rate of penetration.

SUMMARY OF THE INVENTION

The bit of this invention has first, second, and third cones, each cone being mounted for rotation about a cone axis while the bit rotates about a bit axis. An outer row and an adjacent row of cutting elements are located on each of the cones. Each of the cutting elements of the adjacent row on each of the cones has a crest extending perpendicular to a direction of rotation of the cone. An annular space or groove is located between the outer row and the adjacent row on each of the cones.

To reduce balling, the narrowest groove between the outer and adjacent rows is made larger than in comparable sized bits of the prior art. The increased width is accomplished by reducing the widths of the crests and re-positioning the rows for bottom coverage. The inner side of the outer row of one of the cones is moved inward a considerable distance for bottom coverage between the widest groove.

Each of the grooves has a width, measured between tips of the outer and adjacent rows, that is greater than a width of the crests of the adjacent row on the same cone. In the embodiments shown, each of the grooves has a width that is greater than one-half of a width of at least one, and preferably all of the other grooves on the same cone. The outer row of one of the cones has an inner side that is tangent to an inner side plane perpendicular to the cone axis. The inner side plane is closer to the bit axis than to a plane containing a backface of said one of the cones.

DETAILED DESCRIPTION OF THE INVENTION

Figure 5:
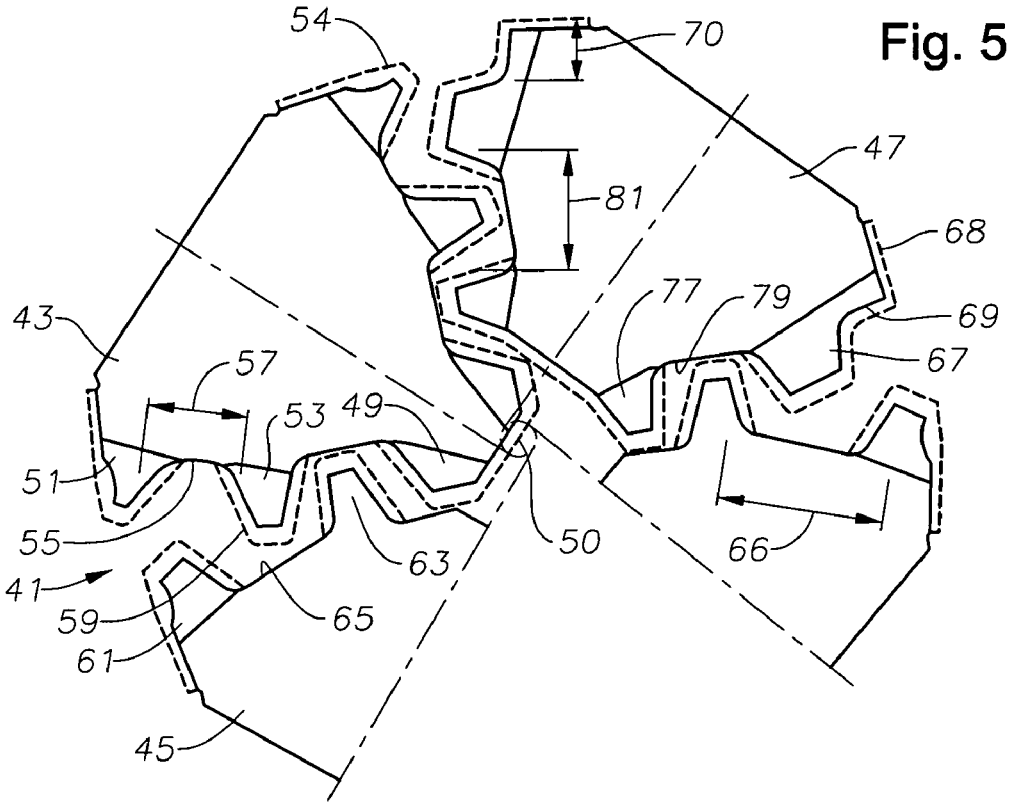
FIG. 5 is a layout of a three-cone bit constructed in accordance with this invention, the bit including the number one cone shown in FIG. 4.

Referring to FIG. 5, bit 41 has three cones 43, 45 and 47. Cone 43 has a cutting element 49 referred to as a spear point on its inner end and a heel or outer row 51 on its outer end. Cutting element 49 extends closer to the bit axis of rotation 50 than any cutting structure on cones 45 and 47. Cone 43 has an outermost adjacent row 53, referred to herein as adjacent row 53, spaced from outer row 51 by an annular space or groove 55. The teeth or cutting elements of cones 43, 45 and 47 are covered with hardfacing 54, shown by the fragmentary lines.

The teeth of cones 43, 45 and 47 are milled teeth that are machined from the metal of the body of the cones. Alternately, the teeth could be cast with the body of the cone, or comprise tungsten carbide compacts press-fitted into holes in the bodies of cones 43, 45 and 47.

Groove 55 is triangular in cross-section and has a width 57 measured between the tips (after hardfacing 54 is applied) of the teeth in outer and inner rows 51, 53. Width 57 is considerably greater than width 26 of groove 25 (FIG. 1) of a comparably sized bit of the prior art. Preferably, width 57 is greater than the width of a crest 59 of one of the teeth of adjacent row 53 or outer row 51, including hardfacing 54 contained on each tooth. Crest 59 on each tooth is perpendicular to the direction of rotation of cone 43. In this embodiment, the width of crest 59 of each tooth of adjacent row 53 or outer row 51 is less than the width of crest 28 (FIG. 1) of each tooth of inner row 23 or outer row 21 of a comparably sized prior art bit. The reduction in widths of crests 59 over the prior art bit partly accounts for the increase in width 57 of groove 55.

Cone 45 has an outer row 61 and an adjacent row 63 separated by a groove 65. Groove 65 has a width 66 measured at the tips of the teeth between rows 61, 63 that is greater than width 57 of groove 55. However, the amount of difference is not so much as in the prior art bit of FIGS. 1-3. In this example, width 57 is more than half the amount of width 66. In the prior art bit of FIG. 1, width 26 is only about one-third of width 34. In this example, width 66 is greater than width 34 of the comparably sized prior art bit 11 of FIG. 1. The inner side of adjacent row 63 is preferably spaced closer to the inner end of cone 45 than in the comparably sized prior art bit of FIG. 1.

Figure 1:
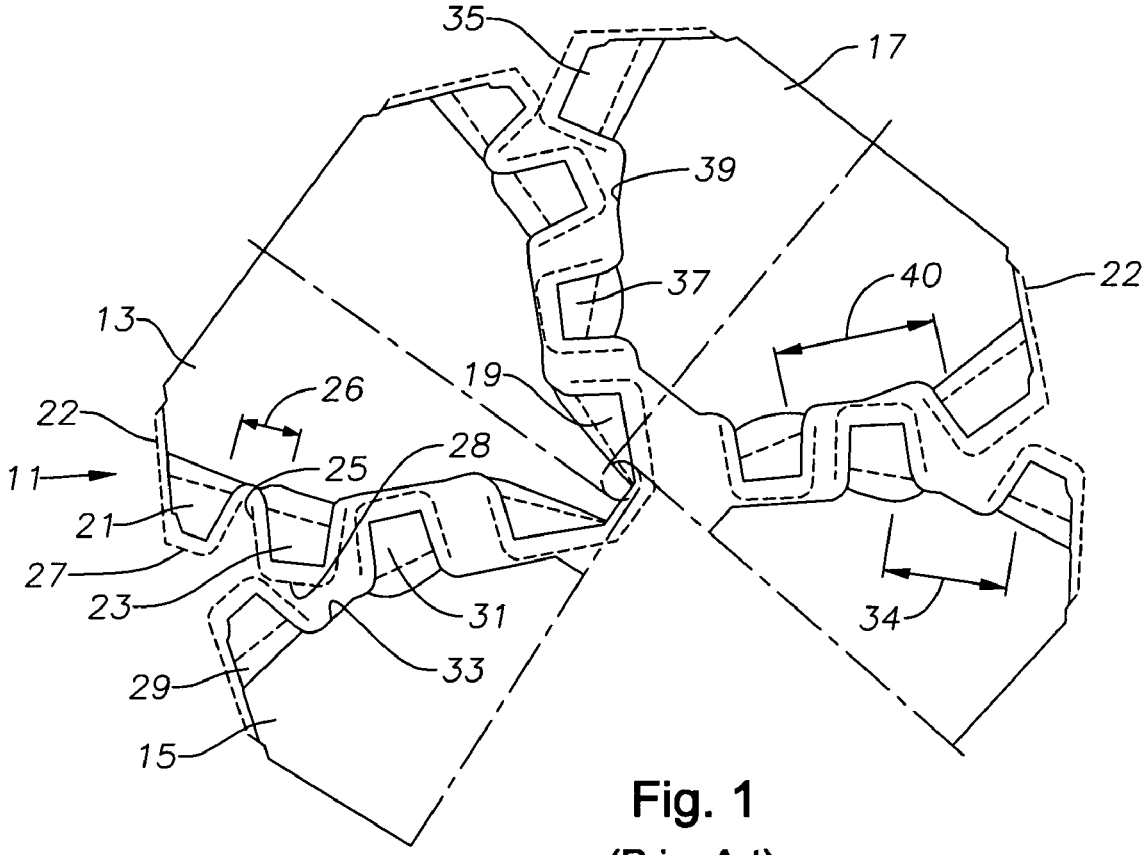
Fig. 1 (Prior Art)
FIG. 1 is a layout of a prior art three-cone bit.

Cone 47 has an outer row 67 that has an outer side spaced inward from gage surface 68 in this example. In this embodiment, the outer side of outer row 67 is spaced inward from gage surface 68 by an annular space 69 having a width 70. Annular space width 70 is slightly less than the width of crest 59 of each of the teeth of outer row 67 in this example. The width of each tooth of outer row 67 is less than a comparably sized tooth of outer row 35 (FIG. 1).

Figure 6:
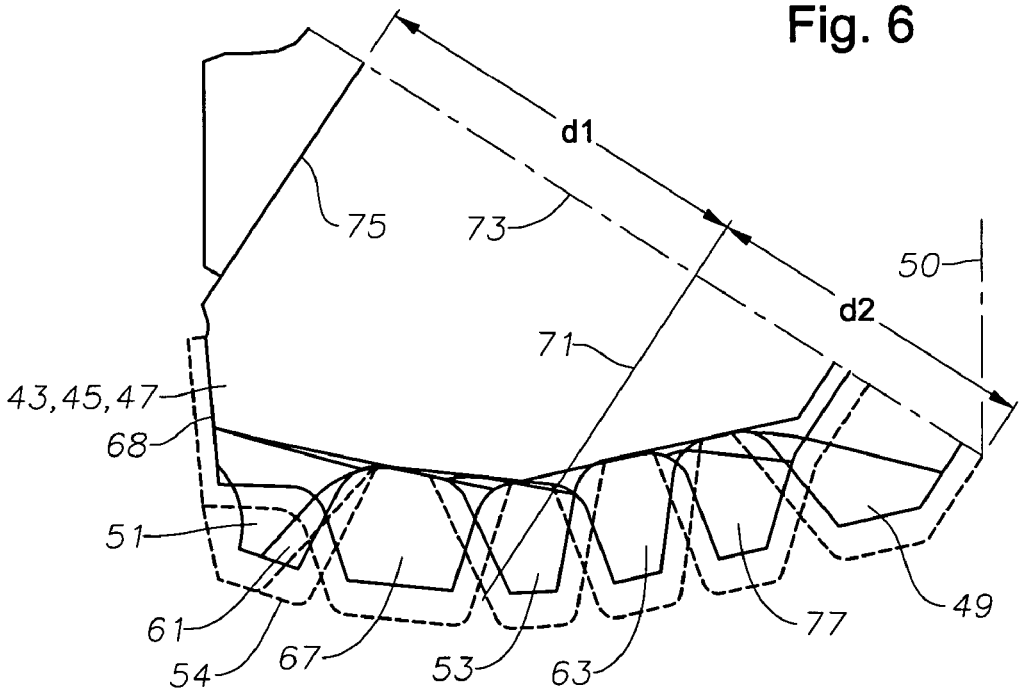
FIG. 6 is a layout of the bit of FIG. 5, with the teeth of the cones shown rotated into a single section plane to show bottom coverage.

The inner side of outer row 67 is closer to bit axis 50 than the inner side of outer rows 51 and 61 of cones 43 and 45. Furthermore, the inner side of each tooth of outer row 67 is located more inward than the comparable teeth of prior art outer row 35 (FIG. 1). Referring to FIG. 6, plane 71 is perpendicular to cone axis of rotation 73 and is tangent to the inner side of outer row 67 of cone 47. Plane 71 is spaced a distance d1 from the cone backface 75 and a distance d2 from bit axis 50. Distance d2 is smaller than distance d1, placing the inner side of outer row 67 of cone 47 closer to bit axis 50 than to cone backface 75. A similar plane (not shown) in the prior art example of FIG. 2 would intersect the cone axis closer to the backface than the bit axis.

Adjacent row 77 of cone 47 is spaced from outer row 67 by a groove 79. Groove 79 has a width 81 that is approximately the same as width 40 of a comparably sized prior art bit 11 (FIG. 1). The width of the crest 59 of each tooth of adjacent row 77 is less than the width of crest 28 of prior art bit 11 (FIG. 1).

Figure 2:
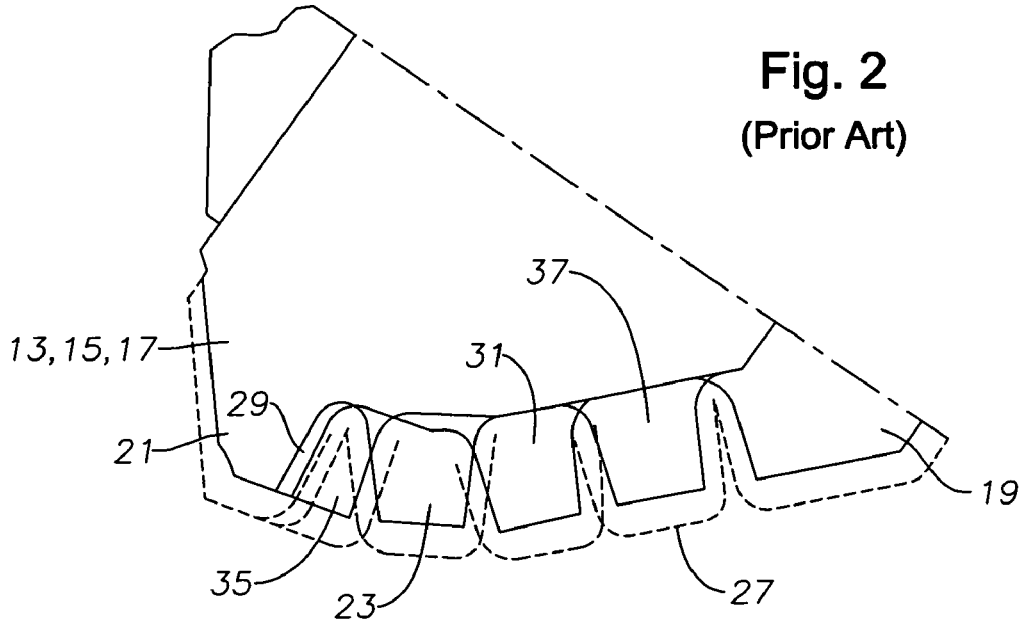
Fig. 2 (Prior Art)
FIG. 2 is a layout of the prior art bit of FIG. 1, with the teeth of the cones rotated into a single section plane.
Figure 3:
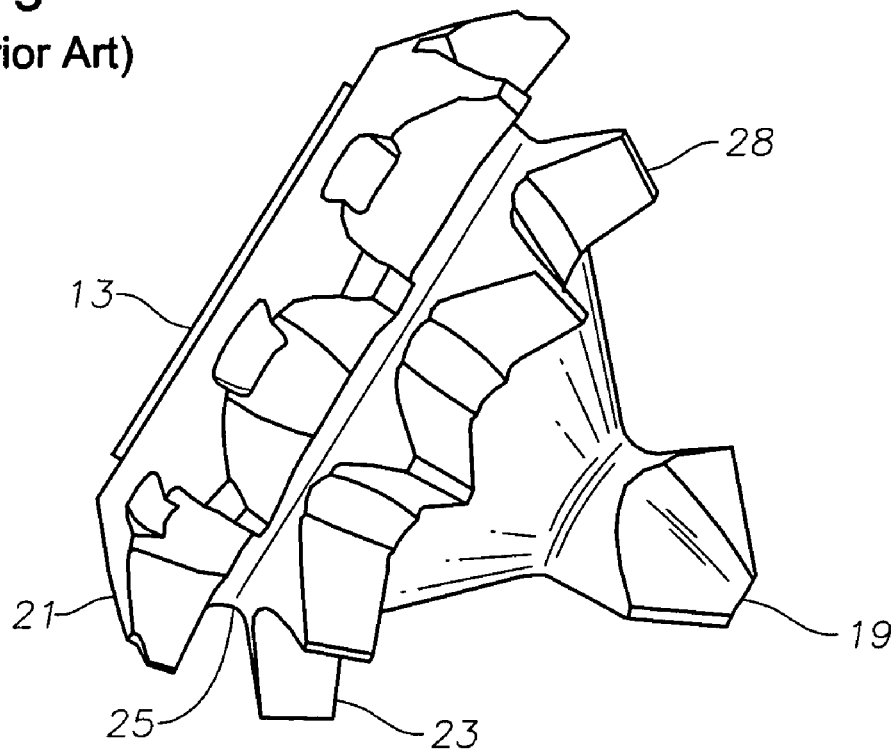
Fig. 3 (Prior Art)
FIG. 3 is a side view of the number one cone of the prior art bit of FIG. 1 before the application of hardfacing.
Figure 4:
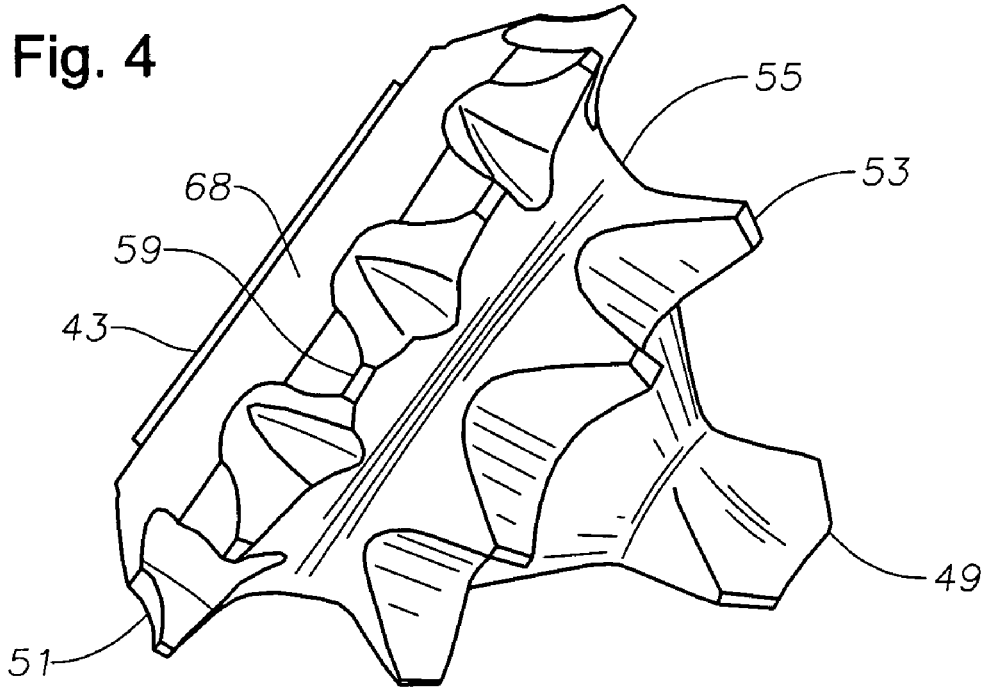
FIG. 4 is a side view of a comparably sized number one cone before the application of hardfacing and constructed in accordance with this invention.

Referring still to FIG. 6, the reduction in widths of crests 59 of some of the rows and the placement of the various rows provides approximately the same bottom coverage as in the prior art bit of FIG. 2. In the first embodiment of this invention, the center line of outer row 67 of cone 47 locates equidistant between outer row 51 and adjacent row 53 of cone 43. Outer row 67 of cone 47 and adjacent row 53 of cone 43 locate between rows 61 and 63 of cone 45. Both cone 43 adjacent row 53 and cone 45 adjacent row 63 locate between cone 47 outer row 67 and cone 47 adjacent row 77.

When the bit has more or less than seven rows of teeth, the location of narrowest width 57 might be on cone 45 or cone 47. When the bit has more or less than seven rows of teeth, the location of outer row 67, which has reduced width crests 59 and is off-gage, might be on cone 43 or cone 45. Increasing the narrowest width 57 does not necessarily require providing an outer row 67 that has reduced width crests 59 and is off-gage. Outer row 67 could have crests 59 of conventional width and have its outer sides flush with the gage. Alternately, outer row 67 could be staggered, with alternating teeth of varying width crests.

Figure 7:
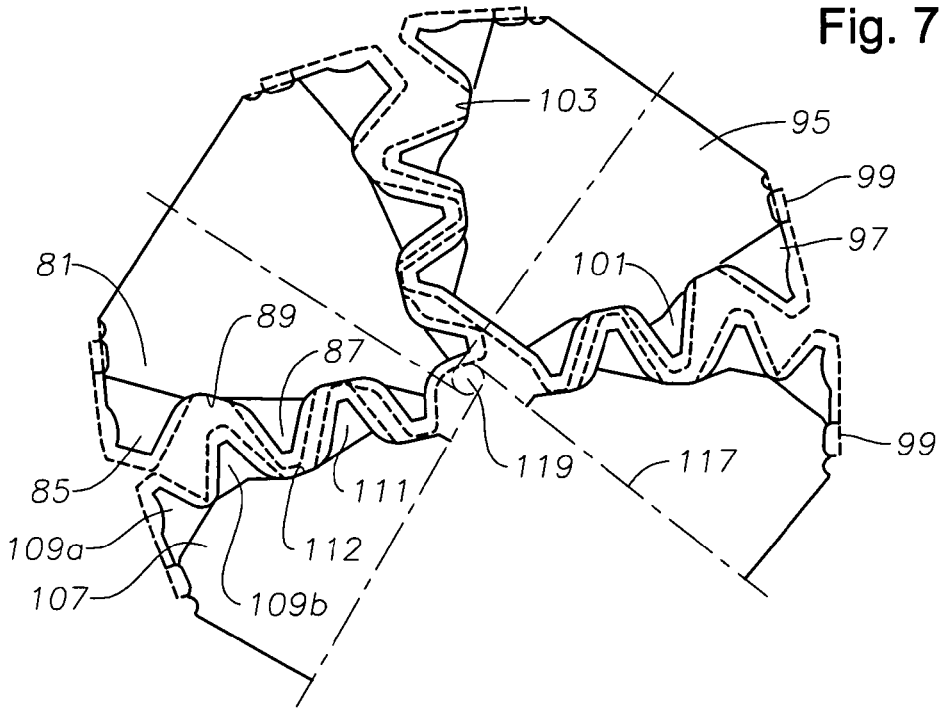
FIG. 7 is a layout of an alternate embodiment of a bit constructed in accordance with this invention.
Figure 8:
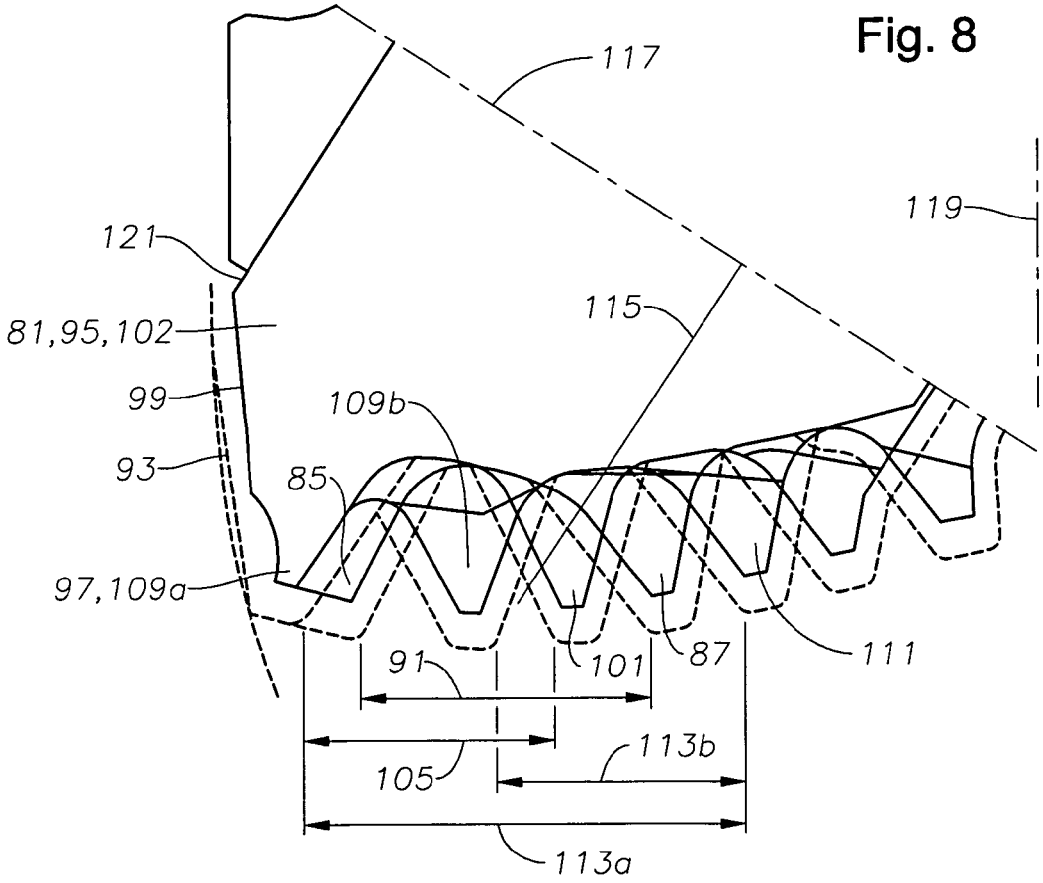
FIG. 8 is a layout of the bit of FIG. 7, with the teeth of the cones shown rotated into a single section plane to show bottom coverage.
Figure 9:
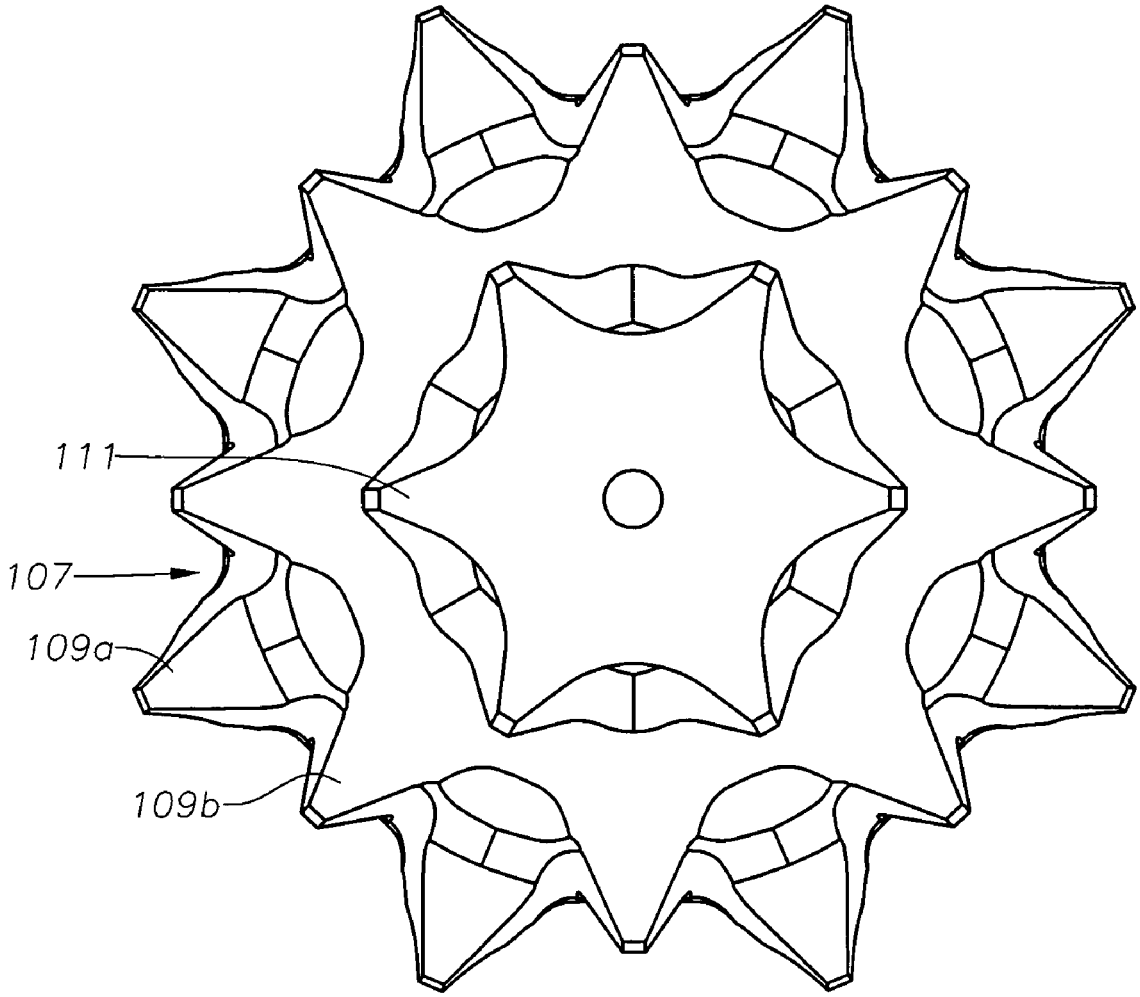
FIG. 9 is a top view of the third cone of the bit of FIG. 7.

A second embodiment is shown in FIGS. 7-9. Cone 83 has an outer row 85 and an adjacent row 87 separated by a groove 89. FIG. 8 shows width 91 between the tips of outer row 85 and adjacent row 87 after the application of hardfacing 93. Cone 95 has an outer row 97 in which all of the teeth have outer sides flush with gage surface 99, unlike outer row 67 of FIG. 5. An adjacent row 101 is separated from outer row 97 by annular groove 103. Groove 103 has a width 105 that is less than width 91, as shown in FIG. 8. This differs from the first embodiment where width 57 is less than width 81 (FIG. 5).

Cone 107 has a staggered outer row with outward cutting elements 109*a* and inward cutting elements 109*b*. As shown in FIG. 9, cutting elements 109*a* and 109*b* alternate with each other, with each cutting element 109*b* located equidistant between two cutting elements 109*a*. The number of cutting elements 109*a* is the same as the number of cutting elements 109*b* in this example. The outer sides of outward cutting elements 109*a* are flush with gage surface 99 (FIG. 7). The outer sides of inward cutting elements 109*b* are spaced inward from gage surface 99. In the embodiment shown, the outer sides of inward cutting elements 109*b* are inward from the inner sides of outward cutting elements 109*a*. Adjacent row 111 is not staggered and is located inward from inward cutting elements 109*b*.

An annular groove 112 is located between outer row cutting elements 109*a*, 109*b* and adjacent row 111. Groove 112 has a width 113*a* from outward cutting elements 109*a* to adjacent row 111 and a width 113*b* from inward cutting elements 109*b* to adjacent row 111, as shown in FIG. 8. Width 113*a* is larger than widths 91 and 105. Width 91 is larger than width 105 in this embodiment, thus the narrowest annular groove between adjacent and outer rows in this embodiment is groove 103 of cone 95. Although smaller, width 105 of groove 103 is greater than one-half the widths 91, 113*a* or 113*b*. Also, width 105 of groove 103 is greater than the width of the crests of adjacent row 101.

The inner side of the outer row of cone 107 is considered to be the inner sides of inward cutting elements 109*b*, which is spaced farther inward than outer rows 85 and 97. Plane 115 is tangent to the tips of outer row cutting elements 109*b* on the inner side and perpendicular to cone axis 117. Plane 115 intersects cone axis 117 closer to bit axis 119 than backface 121.

The invention has significant advantages. The arrangement of the teeth reduces balling of shale in the rows adjacent to the narrower grooves and improves removal of drill cuttings because of the greater widths than in the prior art for comparable sized bits. The reduction in balling and better cuttings removal has resulted in greater performance of the bit.

While the invention has been shown in only a few of its forms, it should be apparent to those skilled in the art that it is not so limited but is susceptible to various changes without departing from the scope of the invention.

I claim:

1. An earth boring bit, comprising:

a plurality of cones, each cone being mounted for rotation about a cone axis while the bit rotates about a bit axis;

an outer row and an adjacent row of cutting elements on each of the cones, each of the cutting elements of the adjacent row on each of the cones being generally chisel-shaped and having a crest, each of the crests being an edge surface extending from an outer side to an inner side of each of the cutting elements of the adjacent rows, each of the crests being generally perpendicular to a direction of rotation of the cone on which it is located;

a groove located between the outer row and the adjacent row on each of the cones; and each of the grooves having a width, measured between tips of the outer and adjacent rows, that is greater than a width of the crests of the adjacent row on the same cone.

2. The bit according to claim 1, wherein the width of each of the grooves is greater than one-half of the width of at least one other of the grooves.

3. The bit according to claim 1, wherein the width of each of the grooves is greater than one-half the width of each of the other grooves.

4. The bit according to claim 1, wherein the outer row of one the cones has an inner side that is tangent to an inner side plane perpendicular to the cone axis, the inner side plane being closer to the bit axis than to a plane containing a back-face of said one of the cones.

5. The bit according to claim 1, wherein at least some of the cutting elements of the outer row of one of the cones has an outer side that is spaced inward from a gage surface of the third cone.

6. The bit according to claim 1, wherein cutting elements of the outer row of one of the cone are staggered, with an inward outer row cutting element alternating with an outward outer row cutting element.

7. The bit according to claim 1, wherein each of the cutting elements of the outer row of each of the cones has a crest.

8. An earth boring bit, comprising:

first, second, and third cones, each cone being mounted for rotation about a cone axis while the bit rotates about a bit axis;

an outer row and an adjacent row of cutting elements integrally formed on each of the cones, each of the cutting elements of the adjacent row on each of the cones being generally chisel-shaped and having a crest, each of the crests being an edge surface extending from an outer side to an inner side of each of the cutting elements of the adjacent rows, each of the crests being generally perpendicular to a direction of rotation of the cone on which it is located;

first, second, and third annular spaces located between the outer row and the adjacent row on the first, second, and third cones, respectively;

the third annular space having a width, measured between tips of the outer and adjacent rows, that is greater than a width of the first annular space and a width of the second annular space; and the widths of the first annular space and the second annular space being greater than widths of the crests of the cutting elements in the adjacent row of the first and second cones, respectively.

9. The bit according to claim 8, wherein the width of the first annular space is greater than one-half the width of the second annular space.

10. The bit according to claim 8, wherein the width of the first annular space is greater than one-half the width of the second annular space and the third annular space.

11. The bit according to claim 8, wherein the outer row of one the cones has an inner side that is tangent to an inner side plane perpendicular to the cone axis, the inner side plane being closer to the bit axis than to a plane containing a back-face of said one of the cones.

12. The bit according to claim 8, wherein the outer row of the second cone has an inner side that is tangent to an inner side plane perpendicular to the cone axis, the inner side plane being closer to the bit axis than to a plane containing a back-face of the second cone.

13. The bit according to claim 8, wherein the outer row of the third cone has an inner side that is tangent to an inner side plane perpendicular to the cone axis, the inner side plane being closer to the bit axis than to a plane containing a back-face of the third cone.

14. The bit according to claim 8, wherein at least some of the cutting elements of the outer row of one of the cones has an outer side that is spaced inward from a gage surface of the third cone.

15. The bit according to claim 8, wherein cutting elements of the outer row of the third cone are staggered, with an inward outer row cutting element alternating with an outward outer row cutting element.

16. The bit according to claim 8, wherein each of the cutting elements of the outer row of each of the cones has a crest.

17. The bit according to claim 8, wherein the second annular space is smaller in width than the first annular space.

* * * * *